United States Patent [19]

Grable et al.

[11] 4,071,085

[45] Jan. 31, 1978

[54] WELL HEAD SEALING SYSTEM

[76] Inventors: Donovan B. Grable, 2515 San Francisco Ave., Long Beach, Calif. 90806; Bill C. Laney, Suite I-308, 4445 Pacific Coast Highway, Torrance, Calif. 90505

[21] Appl. No.: 736,721

[22] Filed: Oct. 29, 1976

[51] Int. Cl.[2] ..... E21B 33/03

[52] U.S. Cl. ..... 166/84; 166/88; 251/1 B

[58] Field of Search ..... 166/84, 88, 82, 86, 166/89, 87; 251/1 B, 1 A, 1 R

[56] References Cited

U.S. PATENT DOCUMENTS

| | | | |
|---|---|---|---|
| 1,511,529 | 10/1924 | Standlee | 251/1 A |
| 1,709,949 | 4/1929 | Rasmussen et al. | 166/86 |
| 2,071,197 | 2/1937 | Burns et al. | 251/1 B |
| 2,842,386 | 7/1958 | Regan | 166/82 |
| 3,084,745 | 4/1963 | Floyd | 166/89 |
| 3,939,910 | 2/1976 | Bruce | 166/84 |

*Primary Examiner*—James A. Leppink
*Attorney, Agent, or Firm*—William W. Haefliger

[57] ABSTRACT

Well flow control apparatus includes a blow-out preventer or preventers removably installable in a well head. By-pass porting may be provided in the well head to by-pass the preventers; a shroud may be employed over the head to confine gases against leakage; and a special valve assembly may be provided to control production fluid flow.

26 Claims, 7 Drawing Figures

WELL HEAD SEALING SYSTEM

BACKGROUND OF THE INVENTION

This invention relates generally to the control of production fluid flow from and within wells; more specifically, it concerns apparatus and method for controlling such flow within a well head and to the exterior of same.

There is need for apparatus capable of controlling flow of well fluid within a well head in such manner that control pressure transmitted to the head effects the desired control of production fluid flow, the control apparatus also being capable of ready downward installation into the head and upward withdrawal therefrom. More specifically, there is need for apparatus of this character which will selectively control flow in either or both tubing and the annulus about the tubing. Further, the apparatus should be compatable with installation of tubing into the well and withdrawal therefrom, as well as installation of sucker rod. Another advantage of such apparatus lies in the maintenance of the well in sealed condition to prevent escape of corrosive gases such as hydrogen sulfide, during well operation and during repair of the stuffing box that cooperates with the polish rod in the rod string. No prior apparatus of which we are aware meets these needs in the unusually advantageous manner as now afforded by the apparatus and methods described below.

SUMMARY OF THE INVENTION

It is a major object of the invention to provide apparatus and method meeting the above needs. Basically, the flow control apparatus comprises:

a. a tubular well head having side porting for flowing well production fluid sidewardly through the head and b. blow-out preventer means downwardly received in the head interior for controlling the flow of well fluid sidewardly through the head via said porting, said means including radially deflectible annular packer structure.

As will appear, the blow-out preventer means may include first and second preventers each including an annular packer, one packer surrounding well tubing extending in the head to control upward flow of production fluid in the annulus about the tubing and to a side port, and the other packer surrounding a sucker rod or polish rod (or other artificial lift structure) extending in the head to control upward flow of production fluid from the tubing past the rod and to a side port in the head. Also, annular hangers may be landed in the head, the hangers respectively supporting the two preventers in the head, the preventers also including metallic sleeves surrounding the packers to form therewith actuating pressure chambers. Actuating pressure is typically delivered to the two chambers via additional side ports in the sleeve and in the head, as will be described. The construction is such that the hangers and attached preventers may easily be installed downwardly in the head, and removed upwardly therefrom, and the tubing may be installed or pulled at the same time; further, a stuffing box for the polish rod may be carried by the upper hanger, and may be repaired after both packers are actuated to seal in the well.

Additional objects include provision for mounting a known commercial blow-out preventer on top of the head in such manner that the hangers, packers and sleeves may be upwardly removed through the commercial preventer; and the provision for installation of a shroud over the stuffing box and well head, to confine any leakage of hydrogen sulfide or other gases, for detection. Additional control means is provided in conjunction with the shroud to effect closure of the packers to shut-in the well in the event of hydrogen sulfide gas or other gas collecting in the shroud. Pressure testing of the head, while closed, is also facilitated.

These and other objects and advantages of the invention, as well as the details of an illustrative embodiment, will be more fully understood from the following description and drawings, in which:

DRAWING DESCRIPTION

Figure 1:
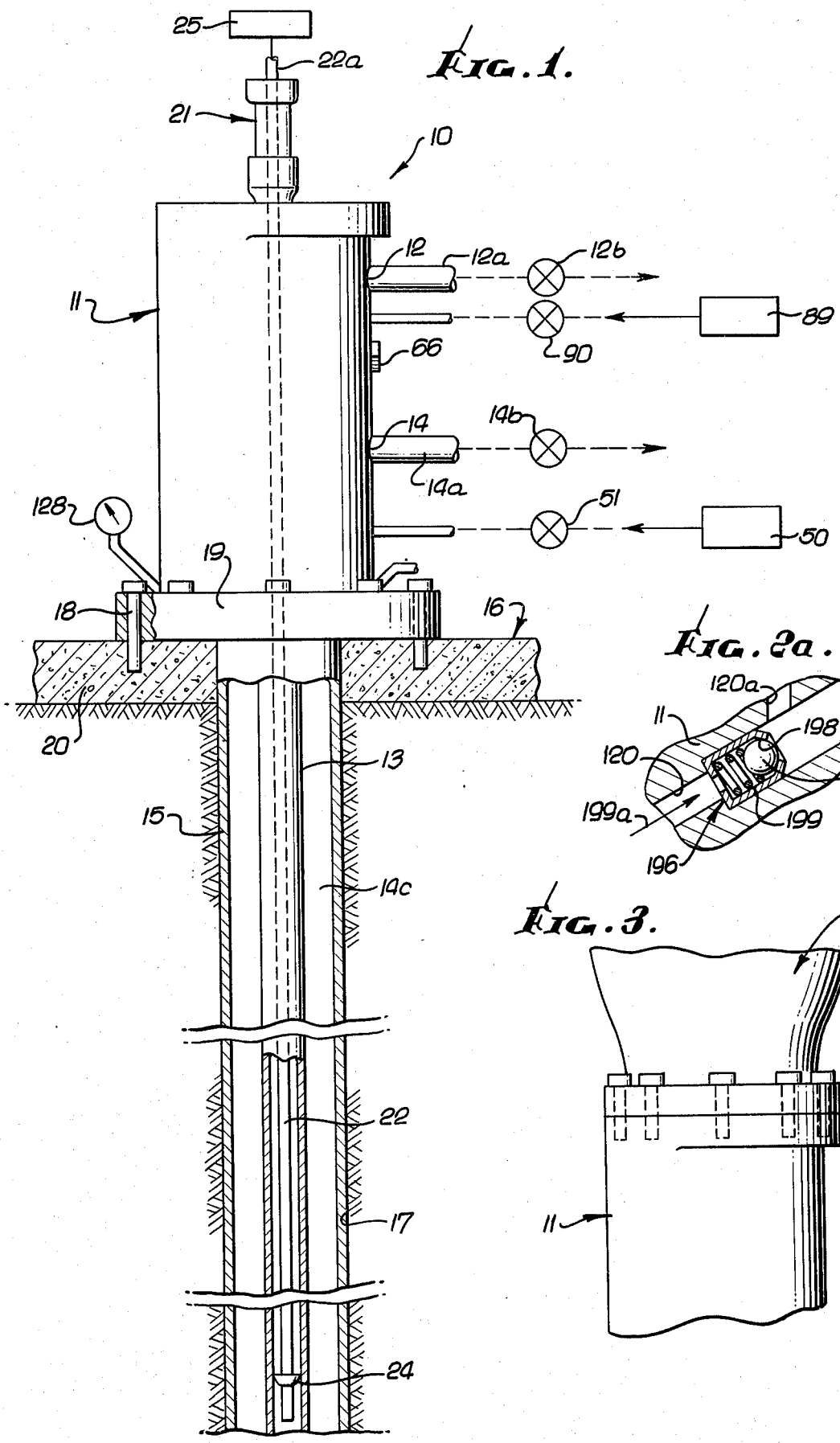
FIG. 1 is a vertical elevation showing a well installation incorporating the invention.
Figure 2A:
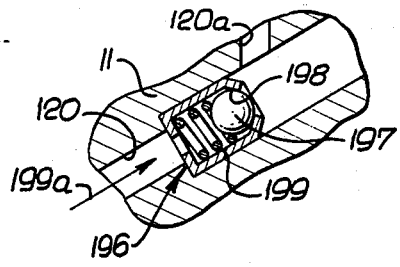
FIG. 2 is an enlarged vertical section taken axially through the FIG. 1 well head.
Figure 3:
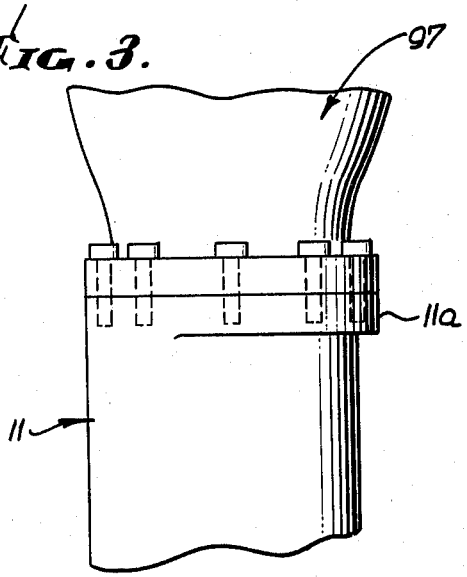
Figure 2:
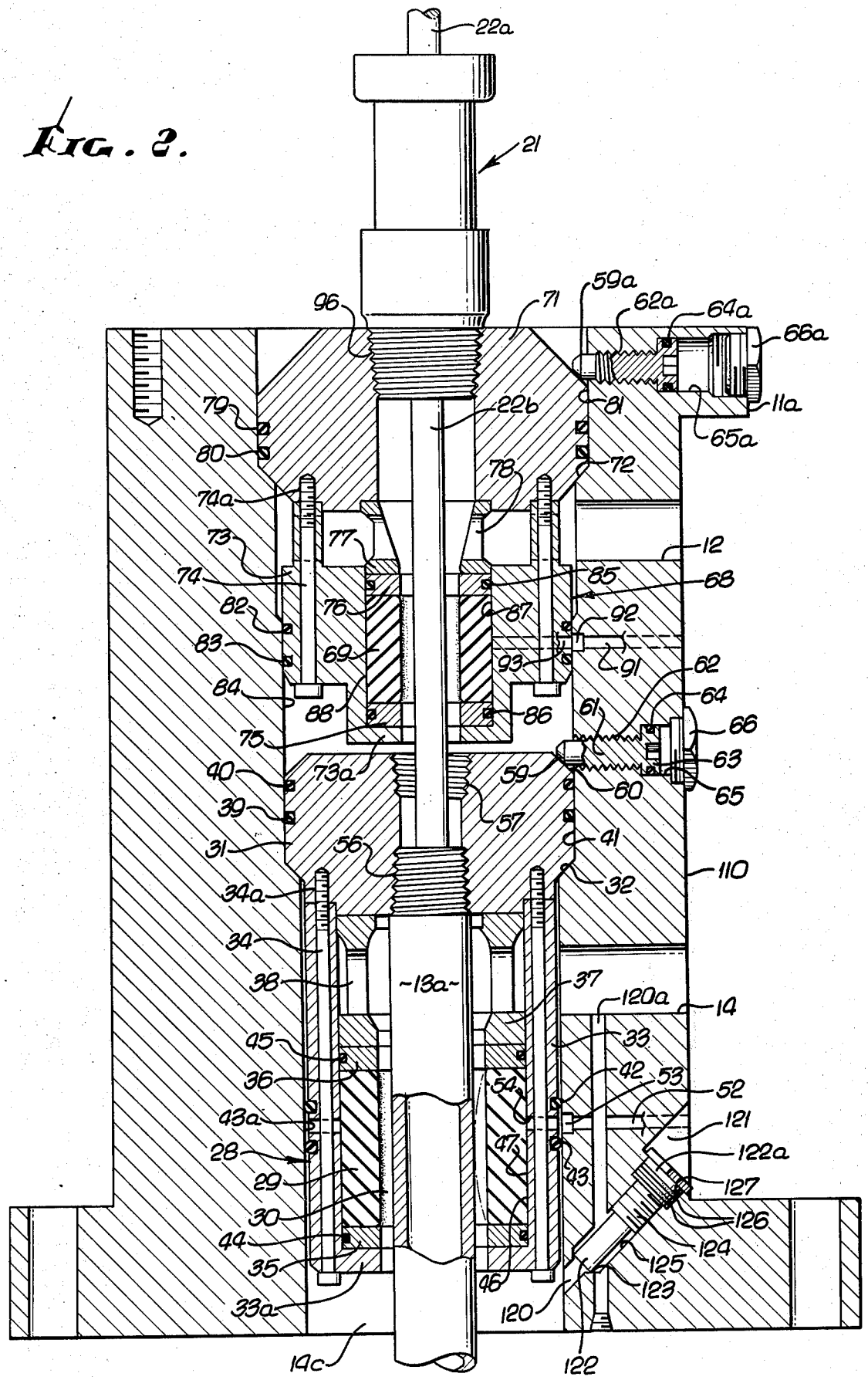
Figure 4A:
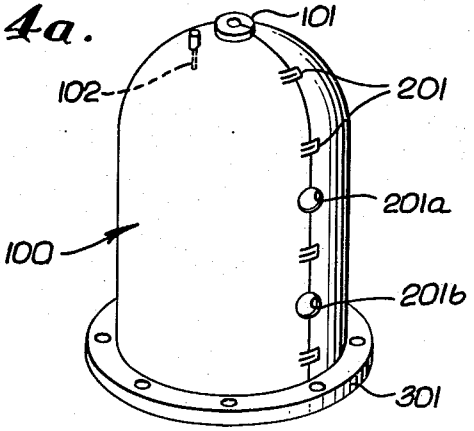
Figure 4:
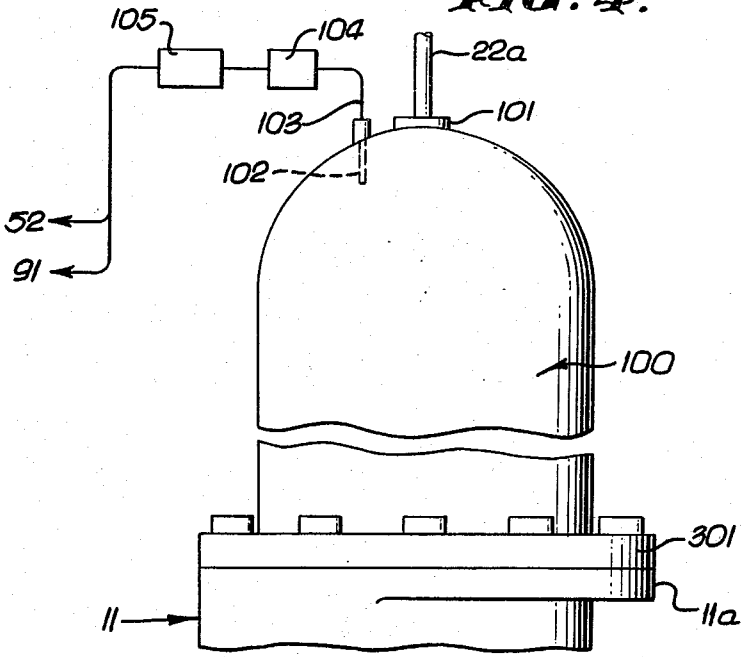

FIG. 2*a* is an enlarged fragmentary view;

FIG. 3 is a fragmentary elevation showing connection of a spacer and blow-out preventer on the well head of FIGS. 1 and 2;

FIG. 4 is a fragmentary elevation showing connection of a shroud and controls onto the well head of FIGS. 1 and 2;

FIG. 4*a* is a perspective view of the FIG. 4 shroud; and

Figure 5:
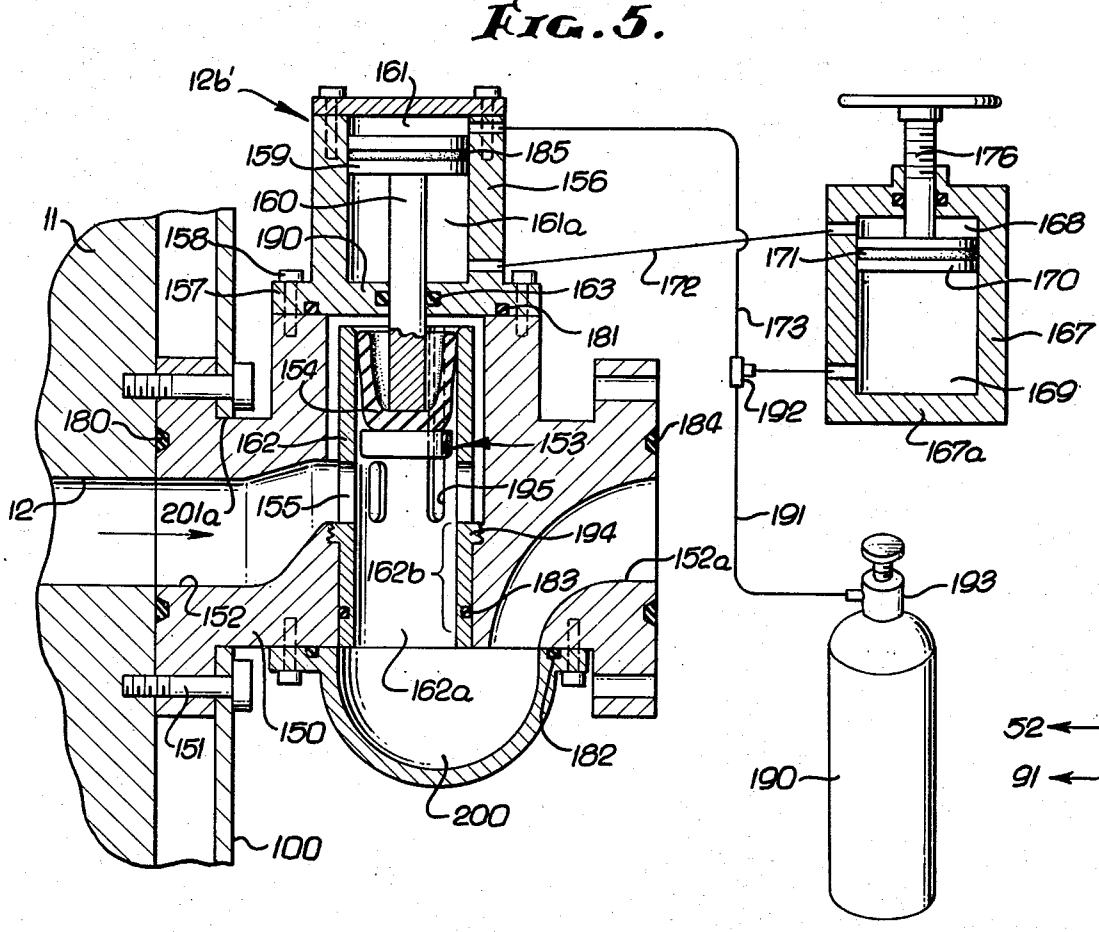

FIG. 5 shows valving apparatus connectible to the head.

DETAILED DESCRIPTION

Referring to FIGS. 1 and 2, the well flow control apparatus 10 includes a tubular well head 11 having side porting for flowing well production fluid sidewardly through the head. Such porting may include an upper side port 12 to receive and pass upward flowing production fluid from a tubing string 13 in the well, and a lower side port 14 to receive and pass upward flowing well production fluid from the annulus 14*c* between the tubing and well casing 15. Flow lines 12*a* and 14*a* receive the flow from the side ports, and valves 12*b* and 14*b* control such flow. The head 11 may be suitably supported as at 16 at the top of the well 17; for example, bolts 18 may connect the head flange 19 to structure 20. A stuffing box 21 extends upwardly from the head, and passes a polish rod 22*a* attached to a pump rod string 22 extending downwardly within the tubing. The rod string is attached to a bottom-hole pump, as for example swab 24, other type pumps being usable. Means to vertically reciprocate the polish rod is indicated at 25.

In accordance with the invention, blow-out preventer means is landed or received downwardly in the head interior for controlling the flow of well fluid sidewardly through the tubular head and via the side porting, such preventer means including radially deflectible annular packer structure. Referring to FIG. 2, the blow-out preventer means advantageously includes a first blow-out preventer 28 that includes a first annular packer 29 annularly surrounding a well tubing zone (defined for example by tubing extent 13*a*) to control upward flow of well fluid from region 14*c* to the annulus 30 about the tubing and to a first side port such as port 14 previously described. Such fluid may for example consist of well gas.

The sleeve shaped packer 29 is suspended by a first annular hanger 31 landed in the head, as by annular shoulder 32, and the first preventer 28 may advantageously include a first metallic sleeve 33 suspended by hanger 31, as by fasteners 34 extending axially in sleeve 33 and having threaded connection at 34*a* to the hanger.

Metallic sleeve 33 extends coaxially with the packer 29, and has a lower interior flange 33*a* which supports the packer via a spacer ring 35. A second spacer ring 36 is located at the upper end of the packer, and a spool spacer 37 is confined between spacer 36 and the underside of the hanger.

The bores of elements 35, 36 and 37 are spaced radially outwardly from, but are coaxial with, the tubing extent 13*a*, for passing well fluid upwardly to port 14, as via side through openings 38 in spool 37. O-ring seals 39 and 40 carried by the hanger 31 seal off between that hanger and the head bore 41, and O-ring seals 42 and 43 carried by sleeve 33 seal off between that sleeve and the head bore 43*a*.

Further O-ring seals 44 and 45 carried by spacers 35 and 36 seal off between those spacers and the sleeve bore 46, thereby providing a first actuating pressure receiving chamber 47 between the packer 29 and bore 46. Actuating pressure as from a source, as at 50 in FIG. 1, is communicated as via a control valve 51, through side wall porting 52 in the head to annulus 53 between seals 42 and 43, and through lateral porting 54 in the sleeve to the pressure chamber 47. Accordingly, control fluid pressure supplied to chamber 47 is operable to resiliently deflect the packer sleeve inwardly to seal off about tubing 13*a* and prevent flow of production fluid to port 14. In this regard, partial closure of the annulus 30 effects control of fluid discharge via port 14, depending upon the extent of such closure. In open condition, the cross sectional area of annular passage 30 is preferably equal to or greater than the bore area of port 14, so that the latter acts as a choke.

It will also be noted that tubing 13 is advantageously suspended by first hanger 31, as at lower side threaded interconnection 56. A threaded connection 57 at the upper side of that hanger facilitates reception of a threaded withdrawal member for pulling the hanger, tubing and blow-out preventer 28 as a unit, when it is desired to remove the tubing from the well. Alternatively, when the hanger is downwardly landed on shoulder 32, it may be retained or locked in position as by releasable means. The latter may advantageously take the form of one or more locking studs 59 movable laterally in the side wall of the head into and out of position projecting above the beveled annular upper shoulder 60 of the hanger 31. The illustrated stud is shown as integral with a shank 61 having threaded interfit at 62 with the head side wall. A head 63 on the shank carries an O-ring 64 to seal off against the counterbore 65. Separate cap 66 seals against the outer wall of the head. Accordingly, escape of gas, such as hydrogen sulfide, is prevented in all positions of the stud, and the cap 66 may be partially retracted to replace O-ring 64.

In accordance with a further important aspect of the invention, the blow-out preventer means may also include a second blow-out preventer 68 that includes a second annular packer 69 surrounding a rod zone (defined for example by rod extent 22*b*) above the tubing zone previously described. The function of the second packer is to control upward flow of well fluid from the tubing 13*a* to a second side port in the head, as for example upper side port 12 previously described. Such fluid may consist of well liquid and/or gas. The sleeve shaped packer 69 is suspended by a second annular hanger 71 landed in the head, as by annular shoulder 72. The second preventer 68 may advantageously include a second metallic sleeve 73 suspended by hanger 71, as by fasteners 74 extending axially in sleeve 73 and having threaded connection at 74*a* to the second hanger.

Metallic sleeve 73 extends coaxially with packer 69, and has a lower interior flange 73*a* which supports the packer 69 as via a spacer ring 75. A second spacer ring 76 is located at the upper end of packer 69, and a spool spacer 77 is confined between spacer 76 and the underside of the hanger 71. The bores of elements 75–77 are spaced radially outwardly frm, but are generally coaxial with, the rod extent 22*b* for passing well fluid upwardly to port 12, as via the side through opening 78 in spool 77. O-ring seals 79 and 80 carried by the hanger 71 seal off between that hanger and the head bore 81; and O-ring seals 82 and 83 carried by sleeve 73 seal off between that sleeve and the head bore 84.

Further, O-ring seals 85 and 86 carried by the spacers 75 and 76 seal off between those spacers and the sleeve bore 87, thereby providing a second fluid actuating pressure chamber 88 between the packer 69 and bore 87. Actuating pressure as from a source as at 89 in FIG. 1 is communicated as via a control valve 90, through side wall porting 91 in the head to annulus 92 between seals 82 and 83, and through a lateral port 93 in the sleeve 73 to the pressure chamber 88. Accordingly, control fluid pressure supplied to chamber 88 is operable to resiliently deflect the packer sleeve inwardly to seal off about rod extent 22*b* and prevent flow of production fluid from tubing 13*a* to port 12.

FIG. 2 shows the stuffing box 21 for the polish rod 22*a* carried by the second annular hanger 71, as for example by a threaded connection at 96, whereby the stuffing box can be quickly disconnected from the hanger to enable connection of a conventional blow-out preventer onto the upper end of the head, flanged at 11*a*. FIG. 3 shows such a conventional preventer 97 connected to flange 11*a*. The described hangers 31 and 71 and suspended structures can be upwardly removed through such a conventional preventer 97, the latter being for example HYDRIL type preventer. FIG. 4 shows the connection of a shroud 100 to the flange 11*a*, with polish rod extending upwardly through the top of the shroud and sealed off at 101. The optional shroud (made for example of glass fiber) confines leakage of any hydrogen sulphide or other gases. A probe 102 to sense the pressure of such gas within the shroud provides a corresponding signal at line 103 for control 104. The latter then operates a device 105 such as a control pressure accumulator, or a pump, to provide control pressure at one or both ports 52 and 91, to shut-in the well.

Well head shroud 100 provides an envelope for the gas leak potentials of the well head assembly and provides a means of gas detection before it becomes diluted with the atmospheric area of the well head and gas contaminated area. The shroud provides a full well head height enclosure, including the polish rod stuffing box. The enclosure envelope may be of a reinforced fiberglass construction, formed in half sections (axially) and secured by quick disconnect clips 201, as seen in FIG. 4*a*. The shroud envelope will encompass the port valve flanges and shroud openings for such flanges appear at 201*a* and 201*b*. Total well shut-in and related production equipment shut down can be effected by the detection of gases by known instrumentation 104 and 102. A base flange for the shroud appears at 301, and is connectible to the well head.

Reference to FIG. 2 will show that the side of the head 11 is preferably appropriately milled or otherwise formed to provide a flat outer wall 110, and to which line connections may be made for establishing connections to ports 12, 14, 52 and 91.

The apparatus also includes at least one by-pass port in the head 11 to by-pass the flow of fluid between the interior of the head below the preventer means and the head interior above the preventer, providing a means of equalizing pressure differentials for a static pressure opening of the preventer seal. One such port appears at 120 in FIG. 2, extending at a downward and inward angle between the bore below sleeve 33 and the head exterior recess 121. An extension of the port appears at 120*a*. Valve means connected in series with port 120 may include a needle valve stem 122 extending within the port and adapted to seat against beveled interior shoulder 123 to close the port. Stem 122 has threaded interfit at 124 with the bore 125, and the stem head 122*a* carries an annular seal or seals 126 to seal off against the counterbore 127. The head 122*a* is retractable to permit replacement of the seal without total removal of the valve stem.

Multiple by-pass ports as described may be provided, for purposes such as by-passing the flow of well fluid between the annulus 14*a* and the exterior; providing direct access to the well annulus 14*a* for introduction of treatment fluid such as acids or other chemicals to be injected into the well; and to provide a connection for a well pressure gage, indicated at 128 in FIG. 1.

As seen in FIG. 2*a* insert ball check valve unit 196 may be installed in access port 120 for well treatment chemicals and pressure guage installation. Ball check valve 196 is equiped with a ball 197 and seat 198 that provides a normally closed valve, with closure effected by an internal spring 199 and internal system pressure exerted in the direction indicated by arrow 199*a*.

Installation of the pressure guage 128 or chemical injection nozzle into the well head body 11 at ports 120 will depress ball 198 and automatically opens the insert ball check valve to the internal well fluids and pressures. Removal of either the pressure guage 128 or the chemical injection nozzle will automatically return the check valve ball 198 to its normally closed position.

The head interior and seals may easily be pressure tested by pressure application via ports 12 and 14, with the packers 29 and 69 closed against tubing 13*a* and rod 22*b*.

Referring to FIG. 5, the specific valve 12*b'* to control production flow from side port 12 in the head includes a valve body 150 attached at 151 to the head 11, with valve inlet port 152 in direct communication with port 12. Located in the body is a tubular liner 162 in which a thimble or stopper 153 is received for reciprocation therein. The thimble may for example define a swab cup 154 consisting of elastomeric material sealingly engaging the inner walls of the liner. The liner has through porting at 155 in the side thereof to allow production fluid to flow sidewardly into the liner, and then through its open lower end 162*a* to body outlet 152*a* when the stopper is in raised or retracted position, as shown. Conversely, when the stopper is advanced downwardly to extended position below the level of porting 155, the flow is blocked. As the thimble passes porting 155, it wipes the latter clean.

The liner 162 incorporates an externally threaded shoulder 194 as a means of installing liner 162 within the valve body 12, and sealed at 183. Liner 162 provides, in addition to through porting at 155 two diametrically opposed slots 195 which extend upward to the upper extremity of the liner 162. They provide a means of installation and removed from the valve body 12. The extended slots 195 also prevent swab cup 154 from developing an hydraulic lock during the opening operation of the valve, on upward travel of the swab cup.

A fluid pressure responsive actuator is provided to advance and retract the stopper, and typically includes a cylinder 156 attached to body 150 as via flange 157 and fasteners 158. The actuator also includes a piston 159 reciprocable in the cylinder and attached to the stopper as via stem 160. Pressure chambers are defined in the cylinder at 161 and 161*a* above and below the piston 159. Note that an annular interior flange 190 directly below chamber 161*a* passes the stem 160, and seals 163 carried by the flange seal off against the stem.

Means is provided to selectively supply control fluid pressure to opposite sides of the piston 159 to displace it, thereby to effect reciprocation of the stopper as described. Such means may advantageously include a remote auxiliary cylinder 167, closed at its lower end 167*a*, that cylinder defining chambers 168 and 169 at opposite sides of auxiliary piston 170 slidable in the cylinder. Seal 171 carried by the piston seals off against the cylinder interior wall. Chambers 168 and 169 are connected via lines 172 and 173 with chambers 161*a* and 161, as shown. When auxiliary piston 170 is forced downwardly, as by handwheel controlled stem 176, control fluid is forced into chamber 161, to depress piston 159 and close the valve 12*b'*; conversely, when piston 170 is raised, fluid flows to chamber 162 and valve 12*b'* is opened.

From the foregoing, it is clear that a totally enclosed control valving system is provided; that escape of production fluid is prevented, excepting when valve 12*b'* is opened; and that valve 12*b'* may be operated remotely.

Seals are also provided at 180, 181, 182, 183, 184, and 185.

Emergency closure may be effected as by connecting a pressure bottle 190 to line 173 via line 191 and connection 192, and opening the bottle via valve 193 thereon.

In closing the valve the swab cup 154 engages the thimble in the ported section of the liner 162 as the closure operation initiates. The thimble position in the port section of the liner effects an incline orifice, restricting the full flow volume. Progressive closure movement of the thimble swab cup combination causes engagement of the thimble only within the lower closure/seal section 162*b* of the liner 162. The metallic thimble is designed to progressively reduce the fluid flow, with a metal to metal interface within the liner providing an 80% to 95% flow restriction before the swab cup 154 engages the liner closure/seal area 162*b*, which in turn effects a 100% closure. At the point of initial swab cup contact with the liner at 162*b*, line pressure will in effect apply the force necessary to move the swab cup/-thimble into a total 100% closure position within the liner. A 100% over-travel of the swab cup/thimble assembly length within the liner closure seal area provides a steel thimble preceeding the elastomeric material of the swab cup as it enters the liner. Closure seal area 162*b* which will in effect remove foreign material from the seal surface of the liner before the engagement of the swab cup to effect the final closure of the valve. This self cleaning, overriding seal will effectively seal over scale or foreign body accumulations at the seal area. The valve body design at the lower end of liner provides a self cleaning flow chamber 200, presenting accumulation of solids within the valve body 12.

As described, the invention is primarily, directed to the petroleum industry's critical areas of production which now demand an unprecedented control and safety of operations. These critical areas include, but are not necessarily restricted to, uncontrolled gas leaks, and oil leaks, resulting from damage, faulty or worn out valves, pipe lines, seals, gaskets or process equipment. Highly sophisticated leak detection instrumentation is now available to the industry; however, equipment to control the source of the hazard being detected is not available to the industry. The invention provides combined improvements at the well head, which will effectively control and seal all well fluids and gases within the well head body; permanent make-up of all production lines for oil and gas; remote quick disconnect of the stuffing box as may be required for well servicing; provisions for total well servicing and work overs through a blow-out preventor, without the making or breaking of production lines or otherwise opening the well gases and fluids to the atmosphere; and inline port valves will provide positive closure by remote means actuated by a means that is isolated from the environment of the well fluids and external atmospheric conditions. Corrosive salt air conditions cannot effect the functional operation of the valve, and no moving parts are exposed.

The combination of improved well head, quick disconnect stuffing box, inline valves and leak detection provides a total containment method for oil well gases and fluids within a permanently made-up system. Total well shut-in of gases and fluids, and equipment shut down can now be effected by numerous environmental signals.

Referring again to FIG. 2, the numeral 59*a* designates a locking stud like that shown at 59, but operating to retain or lock in position the upper hanger 71. Stud 59*a* has threaded interfit with the head side wall, as shown at 62*a*. The shank carries an O-ring seal 64*a* to seal off against counterbore 65*a*. Cap 66*a* seals against the outer wall of the head.

We claim:

1. In well flow control apparatus, a. a tubular well head having side porting for flowing well production fluid sidewardly through the head, and b. blow-out preventer means downwardly received in the head interior for controlling the flow of well fluid sidewardly through the head via said porting, said means including generally radially deflectible annular packer structure, and c. an annular hanger landed in the head and suspending said packer structure, there being a zone in the head and within the packer structure to generally centrally receive an elongated member.

2. The apparatus of claim 1 wherein well tubing is adapted to extend in the head, said blow-out preventer means including a first blow-out preventer with a first annular packer surrounding the tubing zone to control upward flow of well fluid in the annulus about the tubing and to a first side port therein.

3. The apparatus of claim 1 including a by-pass port in the head to by-pass flow of fluid between the interior of the head below the preventer means and the exterior of the head.

4. The apparatus of claim 1 including a blow-out preventer mounted on and about said head, and in generally coaxial relation therewith.

5. In well flow control apparatus, a. a tubular well head having side porting for flowing well production fluid sidewardly through the head, well tubing adapted to extend in a tubing zone in the head, b. blow-out preventer means downwardly received in the head interior for controlling the flow of well fluid sidewardly through the head via said porting, c. said blow-out preventer means including a first blow-out preventer with a first annular packer surrounding the tubing zone to control upward flow of well fluid in the annulus about the tubing and to a first side port therein, p1 d. and said blow-out preventer means including a second blow-out preventer with a second annular packer surrounding a rod zone above the tubing zone to control upward flow of well fluid from within the tubing and to a second side port in the head, e. at least one of said packers being deflectible.

6. The apparatus of claim 5 wherein the head has flat side wall means to which said first and second side ports extend.

7. The apparatus of claim 5 including by-pass porting in the head to by-pass flow of fluid between the interior of the head below the first blow-out preventer and the exterior of the head, and valve means connected in series with said porting to control said by-pass flow.

8. The apparatus of claim 7 wherein said porting includes multiple ports for by-passing well pressure and for providing access to the well for injection of treatment fluid.

9. The apparatus of claim 7 wherein said valve means include a needle valve stem in the porting, a valve first part having threaded connection with the head and a valve second part carrying a seal to seal-off escape of said by-pass fluid to the exterior via the threaded second part, said second part being retractable to provide access to the seal for replacement thereof.

10. The apparatus of claim 5 including a first annular hanger landed in the head and carrying said first annular packer, and a second annular hanger landed in the head and carrying said second annular packer.

11. The apparatus of claim 10 including a stuffing box carried by the second annular hanger to receive and cooperate with a vertical reciprocable polish rod adapted to extend vertically in the head and into the tubing.

12. The apparatus of claim 11 including said rod extending in said box, and said tubing carried by and terminating at said first hanger.

13. The apparatus of claim 11 including a shroud connected to the head and enclosing the stuffing box, and detector means to detect the pressure of hydrogen sulfide gas collected in the shroud interior.

14. The apparatus of claim 13 including means responsive to the output of said detector means to control delivery of pressure to at least one of said packers to deflect the packer for closing off upward flow of well fluid adjacent that packer when hydrogen sulfide gas is detected in the shroud interior.

15. The apparatus of claim 10 wherein the tubular head defines vertically spaced annular shoulders supporting said hangers, and including means to releasably lock at least one of the hangers in position within the head.

16. The apparatus of claim 10 wherein the first preventer means includes a first metallic sleeve suspended by the first hanger and containing the first annular packer, the first sleeve having a bore which defines with the first packer a first actuating pressure receiving chamber, and the second preventer means includes a second metallic sleeve suspended by the second hanger and containing the second annular packer, the second sleeve having a bore which defines with the second packer a second actuating pressure receiving chamber.

17. The apparatus of claim 16 wherein the head defines a primary control port to pass control pressure via the first sleeve to said first chamber, and a secondary control port to pass control pressure via the second sleeve to the second chamber.

18. Apparatus as defined in claim 17 including seals sealing off between the head bore and said metallic sleeves above and below said primary and secondary control ports.

19. Apparatus as defined in claim 16 including seals sealing off said two chambers proximate upper and lower ends thereof.

20. In well flow control apparatus, a. a tubular well head having side porting for flowing well production fluid sidewardly through the head, well tubing adapted to extend in a tubing zone in the head, b. blow-out preventer means downwardly received in the head interior for controlling the flow of well fluid sidewardly through the head via said porting, said means including annular packer structure certain of which is deflectible, c. said blow-out preventer means including a first blow-out preventer and said packer structure including an annular packer associated with the first preventer and surrounding the tubing zone to control upward flow of well fluid in the annulus about the tubing and to a first side port therein, d. there being a first annular hanger landed in the head and suspending said first annular packer.

21. The apparatus of claim 20 including said tubing suspended by said first annular hanger.

22. The apparatus of claim 20 wherein the first preventer means includes a first metallic sleeve suspended by the first hanger and containing the first annular packer, the first sleeve having a bore which defines with the first packer and first actuating pressure receiving chamber.

23. In well flow control apparatus, a. a tubular well head having side porting for flowing well production fluid sidewardly through the head, well tubing adapted to extend in a tubing zone in the head, b. blow-out preventer means downwardly received in the head interior for controlling the flow of well fluid sidewardly through the head via said porting, said means including annular packer structure, c. said blow-out preventer means including a first blow-out preventer with a first annular packer surrounding the tubing zone to control upward flow of well fluid in the annulus about the tubing and to a first side port therein, d. and a control valve assembly having a body defining an inlet in direct communication with said head first side port, said assembly including a stopper reciprocable within the body to control fluid flow therethrough to a body outlet, and a fluid pressure responsive actuator for the stopper, said actuator and body preventing escape of production fluid excepting via said body outlet when the stopper allows passage of production fluid through the body.

24. The apparatus of claim 23 wherein said assembly includes a tubular liner in the body and within which the stopper is reciprocable, the liner having through porting in the side thereof to allow production fluid to flow into the liner and through the open end thereof when the stopper is in a retracted position, the stopper when in extended position blocking said flow.

25. The apparatus of claim 23 wherein said actuator is a fluid pressure responsive actuator having a cylinder attached to the body, and a piston reciprocable in the cylinder and connected to the stopper.

26. The apparatus of claim 25 including means to selectively supply control fluid pressure to opposite sides of said piston to displace the piston and thereby effect extension and retraction of the stopper, said means including a remote auxiliary cylinder and auxiliary piston therein, said cylinder defining chambers at opposite sides of said auxiliary piston, said chambers connected with the control cylinder to supply control fluid to opposite sides of the piston in the control cylinder.

* * * * *